US007960318B2

(12) United States Patent
Kamano et al.

(10) Patent No.: US 7,960,318 B2
(45) Date of Patent: Jun. 14, 2011

(54) LUBRICATING OIL COMPOSITION FOR INTERNAL COMBUSTION ENGINE

(75) Inventors: Hideki Kamano, Ichihara (JP); Motoharu Ishikawa, Ichihara (JP); Kazuhiro Teshima, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 11/722,524

(22) PCT Filed: Dec. 21, 2005

(86) PCT No.: PCT/JP2005/023540

§ 371 (c)(1), (2), (4) Date: Jun. 22, 2007

(87) PCT Pub. No.: WO2006/068203

PCT Pub. Date: Jun. 29, 2006

(65) Prior Publication Data

US 2008/0020953 A1 Jan. 24, 2008

(30) Foreign Application Priority Data

Dec. 22, 2004 (JP) ..... 2004-371910

(51) Int. Cl.
*C07C 55/02* (2006.01)
*C10M 169/04* (2006.01)

(52) U.S. Cl. ..... 508/192; 508/287; 508/506

(58) Field of Classification Search ..... 508/287, 508/506, 192

See application file for complete search history.

(56) References Cited

U.S. PATENT DOCUMENTS

| | | | | |
|---|---|---|---|---|
| 6,191,330 | B1 * | 2/2001 | Matsuno et al. | 585/21 |
| 6,638,897 | B2 * | 10/2003 | Ogano et al. | 508/192 |

FOREIGN PATENT DOCUMENTS

| | | |
|---|---|---|
| JP | 10 219266 | 8/1998 |
| JP | 2001 158896 | 6/2001 |
| JP | 2002 294271 | 10/2002 |
| JP | 2002 309273 | 10/2002 |
| JP | 2003 096483 | 4/2003 |
| JP | 2003 165991 | 6/2003 |
| JP | 2003 327987 | 11/2003 |
| JP | 2003 336089 | 11/2003 |
| JP | 2004 83746 | 3/2004 |
| WO | 03 033629 | 4/2003 |

OTHER PUBLICATIONS

U.S. Appl. No. 12/593.297, filed Sep. 28, 2009, Teshima, et al.
U.S. Appl. No. 12/593,935, filed Sep. 30, 2009, Kamano.

* cited by examiner

*Primary Examiner* — Glenn A Caldarola
*Assistant Examiner* — Vishal Vasisth
(74) *Attorney, Agent, or Firm* — Oblon, Spivak, McClelland, Maier & Neustadt, L.L.P.

(57) ABSTRACT

The present invention provides a lubricating oil composition comprising a lube base oil comprising a mineral oil and/or a synthetic oil; (A) an alkenylsuccinimide or an alkylsuccinimide and/or a boron-containing derivative thereof in an amount of 0.01 to 0.14% by mass based on the composition in terms of the nitrogen content as an ashless dispersant, wherein an alkenylsuccic acid monoimide or an alkylsuccinic acid monoimide and/or a boron-containing derivative thereof in the ashless dispersant is 0.05% by mass or less in terms of nitrogen content; and (B) a dialkyldiphenylamine compound in an amount of 0.3 to 5.0% by mass and a hindered phenol compound in an amount of 0 to 2.5% by mass based on the composition as an antioxidant, and (C) a sulfated ash of the lubricating oil composition is 1.2% by mass or less.

The lubricating oil composition suitable for internal combustion engines has excellent oxidation stability despite low ash content, exhibits small increase in viscosity and acid number, and can prolong the interval (distance or time) required for changing lubricating oil.

5 Claims, No Drawings

LUBRICATING OIL COMPOSITION FOR INTERNAL COMBUSTION ENGINE

This application is a 371 of PCT/JP05/23540, filed Dec. 21, 2005.

TECHNICAL FIELD

The present invention relates to a lubricating oil composition particularly suitable for internal combustion engines such as gasoline engines, diesel engines, engines employing dimethyl ether fuel, and gas engines. More particularly, the present invention relates to a lubricating oil composition which has excellent oxidation stability despite low ash content, exhibits small increase in viscosity and acid number, and can prolong the interval (distance or time) required for changing lubricating oil.

BACKGROUND ART

An essential function of lubricating oils for internal combustion engines is lubrication of various sliding portions such as piston rings, cylinder liners, crankshafts, and connecting rods, and lubrication of sliding portions of a valve-operating mechanism including a cam and a valve-lifter. In addition, lubricating oils are able to cool the inside of such engines and disperse sludge and uncombusted fuel.

Thus, lubricating oils for internal combustion engines are required to exhibit various properties, and requirements for such properties are becoming more and more severe in accordance with recent years' trends toward lower fuel consumption, higher power, higher driving condition adaptability, etc. of internal combustion engines.

In particularly, exhaust gas cleaning apparatuses (inter alia, particulate filter or an exhaust gas cleaning apparatus) have been developed for diesel engines, and lubricating oil compositions are known to affect such exhaust gas cleaning apparatuses.

A lubricating oil composition containing a metallic detergent may cause deposition, in a filter, of a metallic component originating from the additive, resulting in plugging of the filter and lowering of catalytic activity. Therefore, demand has arisen for lowering the ash content of lubricating oil.

When a metallic detergent and an anti-wear agent, which are additives containing a metallic component, are used in reduced amounts, antioxidation performance and heat resistance are impaired. In this case, impairment of such a lubricating oil is accelerated, to thereby shorten the interval (distance or time) required for changing lubricating oil.

Meanwhile, in order to attain complete combustion of light oil fuel, the dead volume above the piston must be reduced. Therefore, recently, pistons with a higher top ring placement as compared with conventional pistons have become popular.

As the top ring position is elevated, the employed lubricating oil is subjected to higher temperature conditions, and viscosity and acid number of the lubricating oil increase due to oxidation-related impairment, thereby shortening the interval (distance or time) required for changing lubricating oil.

Addition of a phenol compound or an amine compound to a lubricating oil composition is a conventional technology for enhancing oxidation stability of the composition (see, for example, Patent Documents 1 to 11).

Another conventional technology for preventing impairment of a lubricating oil is addition, to a lube base oil, of an organic zinc dithiophosphate having secondary hydrocarbon group having 5 to 20 carbon atoms, an alkaline earth metal salicylate salt, and a boron-containing derivative of an alkenylsuccinimide having a boron/nitrogen atomic ratio of 0.2 to 0.4 (see, for example, Patent Document 12). However, oxidation stability of the lubricating oil is not satisfactorily enhanced through this technique.

In a technique for enhancing oxidation stability against $NO_X$, (a) polyalkenylsuccinimide and/or a boron-containing derivative thereof (4 to 10% by wt.), (b) a specific diarylamine (0.7 to 1.5% by wt.), and (C) a specific hindered phenol (0.7 to 1.5% by wt.) are incorporated into a lube base oil (see, for example, Patent Document 13). In the Example section of the disclosed document, phenylnaphthylamine is employed as diarylamine. Enhancement in oxidation stability is unsatisfactory.

Patent Document 1: Japanese Patent Application Laid-Open (kokai) No. 6-93281

Patent Document 2: Japanese Patent Application Laid-Open (kokai) No. 7-331270

Patent Document 3: Japanese Patent Application Laid-Open (kokai) No. 8-302378

Patent Document 4: Japanese Patent Application Laid-Open (kokai) No. 9-3463

Patent Document 5: Japanese Patent Application Laid-Open (kokai) No. 9-71795

Patent Document 6: Japanese Patent Application Laid-Open (kokai) No. 2001-158896

Patent Document 7: Japanese Patent Application Laid-Open (kokai) No. 2002-53888

Patent Document 8: Japanese Patent Application Laid-Open (kokai) No. 2002-371292

Patent Document 9: Japanese Patent Application Laid-Open (kokai) No. 2003-327987

Patent Document 10: Japanese Patent Application Laid-Open (kokai) No. 2004-107556

Patent Document 11: Japanese Patent Application Laid-Open (kokai) No. 2004-131742

Patent Document 12: Japanese Patent Application Laid-Open (kokai) No. 9-235579

Patent Document 13: Japanese Patent Application Laid-Open (kokai) No. 7-126681

DISCLOSURE OF THE INVENTION

In view of the foregoing, an object of the present invention is to provide a lubricating oil composition suitable for internal combustion engines, which composition exhibits small increase in viscosity, exhibits excellent oxidation stability, has such a low ash content as not to adversely affect an exhaust gas cleaning apparatus, and can be satisfactorily adapted to a new emission gas control in future.

The present inventors have conducted extensive studies in order to attain the aforementioned object, and have found that the interval (distance or time) required for changing lubricating oil can be prolonged through incorporation of an alkenylsuccinimide or an alkylsuccinimide and/or a boron-containing derivative thereof serving as ashless dispersants, and a specific antioxidant in predetermined amounts into a lubricating oil, in order to prevent increase in viscosity of the oil which would otherwise be caused by oxidation-related deterioration of the oil.

The present invention has been accomplished on the basis of this finding.

Accordingly, the present invention is directed to the following lubricating oil compositions.

1. A lubricating oil composition comprising a lube base oil comprising a mineral oil and/or a synthetic oil;

(A) an alkenylsuccinimide or an alkylsuccinimide and/or a boron-containing derivative thereof in an amount of 0.01 to 0.14% by mass based on the composition in terms of the nitrogen content as an ashless dispersant, wherein an alkenylsuccic acid monoimide or an alkylsuccinic acid monoimide and/or a boron-containing derivative thereof in the ashless dispersant is 0.05% by mass or less in terms of nitrogen content; and (B) a dialkyldiphenylamine compound in an amount of 0.3 to 5.0% by mass and a hindered phenol compound in an amount of 0 to 2.5% by mass based on the composition as an antioxidant, and (C) a sulfated ash of the lubricating oil composition is 1.2% by mass or less.

2. A lubricating oil composition as described in 1, wherein the alkenylsuccinimide or the alkylsuccinimide is a succinic acid monoimide and/or a succinic acid bisimide each having an alkenyl group or an alkyl group having a weight average molecular weight of 500 to 3000.

3. A lubricating oil composition as described in 1 or 2, wherein the alkenylsuccinimide or the alkylsuccinimide has a ratio of succinic acid monoimide to succinic acid bisimide of 1 or less in terms of the nitrogen content.

4. A lubricating oil composition as described in any of 1 to 3, which further comprises, as a metallic detergent, an alkaline earth metal salicylate having a base number of 30 to 600 mgKOH/g in an amount of 100 to 2,800 ppm by mass in terms of the metal.

5. A lubricating oil composition as described in any of 1 to 4, which is a lubricating oil for use in a diesel engine.

The lubricating oil composition of the present invention which has excellent oxidation stability despite low ash content, exhibits small increase in viscosity and acid number, and can prolong the interval (distance or time) required for changing lubricating oil. Therefore, the composition of the invention is suitable for a lubricating oil for use in internal combustion engines, particularly for a lubricating oil for diesel engines.

In addition, the lubricating oil composition for internal combustion engines can be satisfactorily adapted to future emission gas controls.

BEST MODES FOR CARRYING OUT THE INVENTION

The base oil employed in the lubricating oil composition of the present invention is a mineral oil or a synthetic oil.

No particular limitation is imposed on the species of the mineral oil and the synthetic oil. However, when the lubricating oil composition is employed in internal combustion engines, the base oil generally has a kinematic viscosity, as determined at 100° C., of 1 to 100 $mm^2/s$, preferably 2 to 40 $mm^2/s$.

When the kinematic viscosity, as determined at 100° C., is less than 1 $mm^2/s$, wear increases in valve-operating portions and bearing portions, whereas when the kinematic viscosity is in excess of 100 $mm^2/s$, fuel save performance is impaired.

The mineral oil may be a normal pressure distillate of paraffin base crude, intermediate base crude, naphthene base crude, or a similar crude oil, a distillate obtained through distillation under reduced pressure of the residual oil of normal pressure distillation, or refined oil obtained through a conventional process. Examples of the refined oil include solvent-refined oil, hydrogenated oil, dewaxed oil, and clay-treated oil.

Examples of the synthetic oil include an α-olefin oligomers having 8 to 14 carbon atoms such as poly(α-olefin), α-olefin copolymer, polybutene, polyisobutylene, alkylbenzene, alkylnaphthalene, monoester, diester, polyol ester, polyoxyalkylene glycol, polyoxyalkylene glycol ester, polyoxyalkylene glycol ether, aromatic ester, hindered ester, silicone oil, and fluorine-containing oil.

Examples of the monoester include n-butyl oleate, 2-ethylhexyl oleate, 2-ethylhexyl stearate, 2-ethylhexyl palmitate, and oleic acid butoxyethyl. Examples of the diester include dioctyl adipate, diisononyl adipate, diisodecyl adipate, di-2-ethylhexyl azelate, diisooctyl azelate, isononyl azelate, di-2-ethylhexyl sebacate, diisooctyl sebacate, diisononyl sebacate, 2-ethylhexyl dodecanedioate. Examples of the polyol ester include esters produced from neopentyl glycol and a carboxylic acid having 8 to 10 carbon atoms and esters produced from trimethylolpropane and a carboxylic acid having 8 to 10 carbon atoms.

In the present invention, the aforementioned mineral oils or synthetic oils may be used singly as the base oil or in combination of two or more species.

The mineral oil and the synthetic oil may be used in combination.

Next, components (A), (B), and (C) employed in the present invention will be described.

The lubricating oil composition of the present invention employs, (A) an alkenylsuccinimide or an alkylsuccinimide and/or a boron-containing derivative thereof as an ashless dispersant.

Examples of preferred alkenylsuccinimide or alkylsuccinimides include an alkenylsuccinic acid monoimide or an alkylsuccinic acid monoimide represented by formula (1) and an alkenylsuccic acid bisimide or an alkylsuccinic acid bisimide represented by formula (2):

(1)

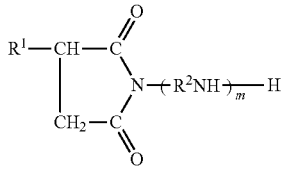

(2)

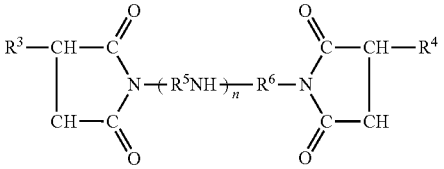

(wherein each of $R^1$, $R^3$, and $R^4$ represents an alkenyl group or an alkyl group each having a weight average molecular weight of 500 to 3,000; $R^3$ and $R^4$ may be identical to or different from each other; each of $R^2$, $R^5$, and $R^6$ represents an alkylene group having 2 to 5 carbon atoms; $R^5$ and $R^6$ may be identical to or different from each other; m is an integer of 1 to 10; and n is 0 or an integer of 1 to 10).

In formulas (1) and (2), each of $R^1$, $R^3$, and $R^4$ is preferably an alkenyl group or an alkyl group having a weight average molecular weight 500 to 3,000, more preferably 1,000 to 3,000.

When the above $R^1$, $R^2$, and $R^3$ have a weight average molecular weight less than 500, the compound has poor solubility in base oil, whereas when the molecular weight is in excess of 3,000, detergency decreases, thereby possibly failing to attain target performance.

The above "m" is preferably 2 to 5, more preferably 3 to 4.

When m exceeds 2, excellent detergency is ensured, whereas when m is less than 5, satisfactory solubility in base oil is attained.

In formula (2), "n" is preferably 1 to 4, more preferably 2 to 3.

When n exceeds 1, excellent detergency is ensured, whereas when n is less than 4, satisfactory solubility in base oil is attained.

Examples of the alkenyl group include a polybutenyl group, a polyisobutenyl group, and ethylene-propylene copolymer. The alkyl group is formed through hydrogenation of the alkenyl group.

Typical examples of preferred alkenyl groups include a polybutenyl group or a polyisobutenyl group.

The polybutenyl group is produced through polymerization of a mixture of 1-butene and isobutene or of a high-purity isobutene.

Typical examples of preferred alkyl groups include a hydrogenated polybutenyl group or a hydrogenated polyisobutenyl group.

Generally, the aforementioned alkenylsuccinimide or alkylsuccinimide may be produced through reaction of polyamine with an alkenylsuccinic anhydride (produced from reaction between polyolefin and maleic anhydride) or an alkylsuccinic anhydride produced through hydrogenation of the alkenyl species.

The aforementioned succinic acid monoimide and succinic acid bisimide may be selectively produced by modifying the ratio of alkenylsuccinic anhydride or alkylsuccinic anhydride to polyamine during reaction.

The aforementioned polyolefin may be formed from olefin monomer; e.g., α-olefins having 2 to 8 carbon atoms singly or incombination of two or more species. Preferably, a mixture of isobutene and butene-1 is employed.

Examples of the polyamine include monomeric diamines such as ethylenediamine, propylenediamine, butylenediamine, and pentylenediamine; and polyalkylenepolyamines such as diethylenetriamine, triethylenetetramine, tetraethylenepentamine, pentaethylenehexamine, di(methylethylene) triamine, dibutylenetriamine, tributylenetetramine, and pentapentylenehexamine.

The boron-containing derivative of an alkenylsuccinimide or an alkylsuccinimide compound which is produced through a conventional method may be employed in the invention.

For example, the aforementioned polyolefin is reacted with maleic anhydride, to thereby form an alkenyl succinic anhydride. The anhydride is imidized with an intermediate which is obtained through reaction of the above polyamine with a boron compound such as boron oxide, boron halide, boric acid, boric anhydride, boric acid ester, or ammonium borate.

No particular limitation is imposed on the boron content of the boron-containing derivative. Generally, the boron content (as boron) is 0.05 to 5% by mass, preferably 0.1 to 3% by mass.

The lubricating oil composition of the present invention comprises an alkenylsuccinimide or an alkylsuccinimide and/or a boron-containing derivative thereof in an amount of 0.01 to 0.14% by mass based on the composition in terms of the nitrogen content as an ashless dispersant, wherein an alkenylsuccinic acid monoimide or an alkylsuccinic acid monoimide and/or a boron-containing derivative thereof in the ashless dispersant is 0.05% by mass or less in terms of nitrogen content.

The amount of the alkenylsuccinimide or alkylsuccinimide and/or a boron-containing derivative thereof is preferably 0.05 to 0.13% by mass.

When the amount of the alkenylsuccinimide or alkylsuccinimide and/or a boron-containing derivative thereof is less than 0.01% by mass, performance of the ashless dispersant cannot fully be attained, whereas when the amount is in excess of 0.14% by mass, viscosity considerably increases, and long drain performance is impaired.

An alkenylsuccic acid monoimide or an alkylsuccinic acid monoimide and/or a boron-containing derivative thereof in the ashless dispersant is preferably 0.01 to 0.04% by mass.

When an amount of alkenylsuccinic acid monoimide or an alkylsuccinic acid monoimide and/or a boron-containing derivative thereof in excess of 0.05% by mass in the ashless dispersant, viscosity considerably increases, and long drain performance is impaired.

In the alkenylsuccinimide or alkylsuccinimide employed in the present invention, the ratio of succinic acid monoimide/succinic acid bisimide is 1 or less, preferably 0.8 or less, more preferably 0.7 or less in terms of nitrogen content.

When the ratio is in excess of 1, viscosity considerably increases, and long drain performance is impaired.

The lubricating oil composition of the present invention employs, (B) a dialkyldiphenylamine compound and an optional hindered phenol compound as an antioxidant.

Examples of the dialkyldiphenylamine compound include mixed alkyldiphenylamine compounds having 4 to 18 carbon atoms.

Specific examples include 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine.

The dialkyldiphenylamine compounds may be used singly or in combination of two or more species.

Examples of the hindered phenol compound include 2,6-di-t-butyl-p-cresol, 4,4'-methylenebis(2,6-di-t-butylphenol), 4,4'-bis(2-methyl-6-t-butylphenol), 2,6-di-t-butyl-4-methylphenol, 2,6-di-t-butyl-4-ethylphenol, 2,4-dimethyl-6-t-butylphenol, 2,6-di-t-butyl-4-(N,N'-dimethylaminophenol), 4,4'-thiobis(2-methyl-6-t-butylphenol), 4,4'-thiobis(3-methyl-6-t-butylphenol), 2,2'-thiobis(4-methyl-6-t-butylphenol), bis(3-methyl-4-hydroxy-5-t-butylbenzyl) sulfide, bis(3,5-di-t-butyl-4-hydroxybenzyl) sulfide, n-octadecyl-3-(4-hydroxy-3,5-di-t-butylphenyl) propionate, 2,2'-thio[diethyl-bis-3-(3,5-di-t-butyl-4-hydroxyphenyl) propionate, 4,4'-methylenebis(2,6-di-t-butylphenol), 4,4'-bis(2,6-di-t-butylphenol), 4,4'-bis(2-methyl-6-t-butylphenol), 2,2'-methylenebis(4-ethyl-6-di-t-butylphenol), 4,4'-butylidenebis(3-methyl-6-di-t-butylphenol), 4,4'-isopropylidenebis(2,6-di-t-butylphenol), 2,6-di-t-butyl-4-methylphenol, 2,6-di-t-butyl-4-ethylphenol, 2,4-dimethyl-t-butylphenol, 2,6-di-t-butyl-(N,N-dimethylaminophenol, 4,4'-thiobis(3-methyl-6-t-butylphenol), 2,2'-thiobis(4-methyl-6-t-butylphenol), bis(3-methyl-4-hydroxy-5-t-butylbenzyl) sulfide, bis(3,5-di-t-butyl-4-hydroxybenzyl) sulfide, 2,2'-dithio-diethylenebis[3(3,5-di-t-butyl-4-hydroxyphenol) propionate], tridecyl-3-(3,5-di-t-butyl-4-hydroxyphenol) propionate, pentaerythrityl-tetrakis[3(3,5-di-t-butyl-4-hydroxyphenol) propionate], octadecyl-3-(3,5-di-t-butyl-4-hydroxyphenol) propionate, and octyl-3-(4-hydroxy-3,5-di-t-butylphenyl) propionate.

Of these, bisphenol and ester-group-containing phenols are particularly preferred.

These hindered phenol compounds may be used singly or in combination of two or more species.

The lubricating oil composition of the present invention comprises an dialkyldiphenylamine compound in an amount of 0.3 to 5.0% by mass and a hindered phenol compound in an amount of 0 to 2.5% by mass based on the composition.

The dialkyldiphenylamine compound content is preferably 0.3 to 2.0% by mass.

When the dialkyldiphenylamine compound content is less than 0.3% by mass, viscosity increases, and long drain performance is impaired, whereas when the content is in excess of 5.0% by mass, the effects are not enhanced commensurate with addition, which is not preferred in economy.

The hindered phenol compound content is preferably 0.2 to 2.5% by mass.

When the hindered phenol compound content is in excess of 2.5% by mass, the effects are not enhanced commensurate with addition, and long drain performance is impaired due to increase in viscosity.

A sulfated ash (C) of the lubricating oil composition of the present invention is 1.2% by mass or less, preferably 1.2% by mass or less based on the composition.

When the sulfated ash is in excess of 1.2% by mass, in the case where the lubricating oil composition is employed in a diesel engine, a DPF (diesel particulate filter) is plugged, to thereby shorten the service life of the filter.

The lubricating oil composition of the present invention generally comprises, as a metallic detergent, an alkaline earth metal salicylate having a base number 30 to 600 mgKOH/g in an amount of 100 to 2,800 ppm by mass based on the composition in terms of the metal.

The alkaline earth metal salicylate preferably has a base number (as determined in accordance with JIS K2501, the perchlorate method) of 30 to 600 mgKOH/g, more preferably 50 to 400 mgKOH/g.

When the base number is less than 30 mgKOH/g, acid-neutrazation performance and detergency are unsatisfacory, whereas when the base number is in excess of 600 mgKOH/g, storage stability decreases.

The alkaline earth metal content is preferably 100 to 2,800 ppm by mass, more preferably 300 to 2,700 ppm by mass.

When the alkaline earth metal content is less than 100 ppm by mass, the effect of the metallic detergent may fail to be fully attained, whereas when the content is in excess of 2800 ppm by mass, the sulfated ash of the lubricating oil composition may exceed 1.2% by mass in some cases.

The alkaline earth metal salicylate is an alkaline earth metal salt of an alkylsalicylic acid, and may be produced through a conventional method including alkylating phenol with an α-olefin having 8 to 18 carbon atoms, subsequently introducing a carboxyl group through the Kolbe-Schmitt reaction, double-decomposing, and carbonating.

Specific examples of the alkylsalicylic acid include dodecylsalicylic acid, dodecylmethylsalicylic acid, tetradecylsalicylic acid, hexadecylsalicylic acid, octadecylsalicylic acid, and dioctylsalicylic acid.

In addition to the salicylate, an alkaline earth metal sulfonate or an alkaline earth metal phenate may appropriately be added to the composition.

To the lubricating oil composition of the present invention, other additives conventionally employed in a lubricating oil for internal combustion engines may appropriately be added in accordance with needs, so long as the effect of the present invention is not impaired. Examples of such additives include an anti-wear agent, a friction modifier, a viscosity index improver, a pour point depressant, a rust preventive, a corrosion inhibitor, and a defoaming agent.

Examples of the anti-wear agent include dithiophosphoric acid metal salts (Zn, Pb, Sb, Mo, etc.), dithiocarbamic acid metal salts (e.g., Zn), sulfur compounds, phosphate esters, phosphite esters, phosphate ester amine salts, and phosphite ester amine salts.

Examples of the friction modifier include molybdenum dialkylthiocarbamate (MoDTC); amines, amides, amine salts, and derivatives thereof; and polyhydric alcohol fatty acid esters, polyhydric alcohol alkyl ethers, and derivatives thereof.

Examples of the viscosity index improver include polymethacrylates, olefin copolymers, and styrene copolymers.

Examples of the pour point depressant include polymethacrylates. Examples of the rust preventive include alkenylsuccinic acids and partial esters thereof. Examples of the corrosion inhibitor include benzotriazole, benzimidazole, and thiazole. Examples of the defoaming agent include dimethylpolysiloxanes, and polyacrylates.

EXAMPLES

The present invention will next be described by way of examples, which should not be construed as limiting the invention thereto.

Examples 1 to 14 and Comparative Examples 1 to 6

As shown in Tables 1-1 to 1-3, lubricating oil compositions falling within a scope of the present invention were prepared from the following base oils and additives, and properties and performance of the composition were evaluated.

(Base Oils and Additives)

Lubricating oil compositions were prepared from the following base oils so that each composition exhibited a kinematic viscosity of 10.5 $mm^2/s$ as measured at 100° C.

1. Base oil 1: a mineral oil having a kinematic viscosity of 4.4 $mm^2/s$ as measured at 100° C.
2. Base oil 2: poly(α-olefin) having a kinematic viscosity of 4 $mm^2/s$ as measured at 100° C.
3. Alkenylsuccinic acid bisimide A: alkenylsuccinic acid bisimide including a polybutenyl group having a weight average molecular weight of 1,000 (nitrogen content: 1.1% by mass, OLOA373, product of Chevron Texaco Japan Co.)
4. Alkenylsuccinic acid monoimide B: alkenylsuccinic acid monoimide including a polybutenyl group having a weight average molecular weight of 1,000 (nitrogen content: 2.0% by mass, Lubrizol 6406, product of Japan Lubrizol Corporation)
5. Alkenylsuccinic acid monoimide boron-containing derivative C: alkenylsuccinic acid monoimide boron-containing derivative including a polybutenyl group having a weight average molecular weight of 1,000 (nitrogen content: 2.3% by mass, boron content: 1.9% by mass, Lubrizol 935, product of Japan Lubrizol Corporation)
6. Dialkyldiphenylamine compound: dialkyldiphenylamine (alkyl: butyl-octyl mixed) [Irganox L57, product of Ciba Specialty Chemicals K. K.]
7. Hindered phenol compound D: 4,4'-methylenebis(2,6-di-t-butylphenol) [Hitec 4710, product of Afton Chemical Japan]
8. Hindered phenol compound E: octyl 3-(4-hydroxy-3,5-di-t-butylphenyl)propionate (Irganox L135, product of Ciba Specialty Chemicals K. K.)
9. Naphthylamine compound F: phenyl-1-naphthylamine (Antigene PA, product of Sumitomo Chemical Co. Ltd.)
10. Calcium salicylate: calcium salicylate having a base number of 170 mgKOH/g (calcium content: 6.1% by mass)
11. Secondary alkyl-type zinc dialkyldithiophosphate: a mixture of zinc di(sec-propyl)dithiophosphate and zinc di(sec-hexyl)dithiophosphate (phosphorus content: 8.2% by mass)

12. Viscosity index improver: Paraton 8220 (product of Chevron Texaco Japan Co.)

13. Other additives: pour point depressant, copper inactivator, etc.

In Tables 1-1 to 1-3, the base oil amounts mean balance so that the total of the components of each lubricating oil composition is adjusted to 100% by mass.

(Test Methods)

1. Sulfated ash test: in accordance with JIS K 2544

2. Evaluation test

To a glass test tube, each lubricating oil composition sample (150 g), copper (25 mm×10 mm×0.5 mm), and iron (25 mm×30 mm×0.5 mm) were placed. Air (500 mL/min) was introduced to the composition sample at 170° C. so as to deteriorate the composition through oxidation.

Sampling was performed at every 24 hour, and kinematic viscosity of each sample at hours 96 and 144 was determined at 100° C., whereby percent viscosity increase was calculated.

The smaller the viscosity increase, the more excellent the oxidation stability.

TABLE 1-1

| | Components | | Amount added | Ex. 1 | Ex. 2 | Ex. 3 | Ex. 4 | Ex. 5 | Ex. 6 | Ex. 7 |
|---|---|---|---|---|---|---|---|---|---|---|
| Base oil | Base oil 1 | | % by mass | bal. | bal. | bal. | bal. | bal. | bal. | bal. |
| | Base oil 2 | | % by mass | | | | | | | |
| Additives | Alkenylsuccinic acid bisimide A | | Nitrogen content ppm by mass | 500 | 1,000 | 800 | 600 | 600 | 600 | 600 |
| | Alkenylsuccinic acid monoimide B | | Nitrogen content ppm by mass | | | 200 | 400 | 400 | 400 | 400 |
| | Alkenylsuccinic acid monoimide boron-containing derivative C | | Nitrogen content ppm by mass | | | | | | | |
| | Dialkyldiphenylamine compound | | % by mass | 0.5 | 0.5 | 0.5 | 0.5 | 0.5 | 0.5 | 1.0 |
| | Hindered phenol compound D | | % by mass | 0.3 | 0.3 | 0.3 | 0.3 | 1.0 | 1.5 | 1.5 |
| | Hindered phenol compound E | | % by mass | | | | | | | |
| | Naphthylamine compound F | | | | | | | | | |
| | Calcium salicylate | | ppm by mass | 2,200 | 2,200 | 2,200 | 2,200 | 2,200 | 2,200 | 2,200 |
| | Viscosity index improver | | % by mass | 6 | 5.5 | 5.5 | 5.5 | 5.5 | 5.5 | 5.5 |
| | Other additives | | % by mass | 1.8 | 1.8 | 1.8 | 1.8 | 1.8 | 1.8 | 1.8 |
| Total nitrogen in alkenylsuccinimide | | | ppm by mass | 500 | 1,000 | 1,000 | 1,000 | 1,000 | 1,000 | 1,000 |
| Sulfated ash | | | % by mass | 0.99 | 0.99 | 0.99 | 0.99 | 0.99 | 0.99 | 0.99 |
| Percent viscosity increase after oxidation (vs. new oil, 100° C.) | | 96 hr | % | 105 | 106 | 105 | 106 | 106 | 108 | 108 |
| | | 144 hr | % | 169 | 171 | 159 | 170 | 169 | 185 | 168 |

TABLE 1-2

| | Components | | Amount added | Ex. 8 | Ex. 9 | Ex. 10 | Ex. 11 | Ex. 12 | Ex. 13 | Ex. 14 |
|---|---|---|---|---|---|---|---|---|---|---|
| Base oil | Base oil 1 | | % by mass | bal. | bal. | bal. | bal. | bal. | bal. | |
| | Base oil 2 | | % by mass | | | | | | | bal. |
| Additives | Alkenylsuccinic acid bisimide A | | Nitrogen content ppm by mass | 600 | 800 | 800 | 600 | 600 | 600 | 800 |
| | Alkenylsuccinic acid monoimide B | | Nitrogen content ppm by mass | 400 | | | 400 | 400 | 400 | |
| | Alkenylsuccinic acid monoimide boron-containing derivative C | | Nitrogen content ppm by mass | | 200 | 200 | | | | 200 |
| | Dialkyldiphenylamine compound | | % by mass | 2.0 | 0.5 | 1.0 | 0.5 | 0.5 | 2.0 | 1.0 |
| | Hindered phenol compound D | | % by mass | 1.5 | 0.3 | 0.3 | | | | 0.3 |
| | Hindered phenol compound E | | % by mass | | | | 1.0 | 2.0 | 2.0 | |
| | Naphthylamine compound F | | % by mass | | | | | | | |
| | Calcium salicylate | | ppm by mass | 2,200 | 2,200 | 2,200 | 2,200 | 2,200 | 2,200 | 2,200 |
| | Viscosity index improver | | % by mass | 5.5 | 5.5 | 5.5 | 5.5 | 5.5 | 5.5 | 6.0 |
| | Other additives | | % by mass | 1.8 | 1.8 | 1.8 | 1.8 | 1.8 | 1.8 | 1.8 |
| Total nitrogen in alkenylsuccinimide | | | ppm by mass | 1,000 | 1,000 | 1,000 | 1,000 | 1,000 | 1,000 | 1,000 |
| Sulfated ash | | | % by mass | 0.99 | 1.00 | 1.00 | 0.99 | 0.99 | 0.99 | 1.01 |
| Percent viscosity increase after oxidation (vs. new oil, 100° C.) | | 96 hr | % | 110 | 106 | 107 | 105 | 106 | 108 | 105 |
| | | 144 hr | % | 119 | 110 | 111 | 110 | 114 | 115 | 108 |

TABLE 1-3

| | Components | Amount added | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Base oil | Base oil 1 | % by mass | bal. | bal. | bal. | bal. | bal. | bal. |
| | Base oil 2 | % by mass | | | | | | |
| Additives | Alkenylsuccinic acid bisimide A | Nitrogen content ppm by mass | 1,500 | 400 | 600 | 600 | 600 | 600 |
| | Alkenylsuccinic acid monoimide B | Nitrogen content ppm by mass | | 600 | 400 | 400 | 400 | 400 |
| | Alkenylsuccinic acid monoimide boron-containing derivative C | Nitrogen content ppm by mass | | | | | | |
| | Dialkyldiphenylamine compound | % by mass | 0.5 | 0.5 | 0.5 | 0.5 | | |
| | Hindered phenol compound D | % by mass | 0.3 | 0.3 | 3.0 | 5.0 | 0.3 | 1.5 |
| | Hindered phenol compound E | % by mass | | | | | | |
| | Naphthylamine compound F | % by mass | | | | | 0.5 | 0.5 |
| | Calcium salicylate | ppm by mass | 2,200 | 2,200 | 2,200 | 2,200 | 2,200 | 2,200 |
| | Viscosity index improver | % by mass | 4.5 | 5.5 | 5.5 | 5.5 | 5.5 | 5.5 |
| | Other additives | % by mass | 1.8 | 1.8 | 1.8 | 1.8 | 1.8 | 1.8 |
| Total nitrogen in alkenylsuccinimide | | ppm by mass | 1,500 | 1,000 | 1,000 | 1,000 | 1,000 | 1,000 |
| Sulfated ash | | % by mass | 0.99 | 0.99 | 0.99 | 0.99 | 0.99 | 0.99 |
| Percent viscosity increase after oxidation (vs. new oil, 100° C.) | 96 hr | % | 107 | 105 | 110 | 117 | 106 | 108 |
| | 144 hr | % | 328 | 320 | 293 | 308 | 392 | 302 |

As is clear from Table 1, lubricating oil compositions of Examples 1 to 14 exhibit small increase in viscosity, indicating that the compositions have excellent oxidation stability and exhibit a prolonged long interval (distance or time) required for changing lubricating oil.

In contrast, lubricating oil compositions of Comparative Examples 1 to 6 exhibit considerable increase in viscosity at hour 144 indicating that the compositions have poor oxidation stability and a short interval (distance or time) required for changing lubricating oil.

Industrial Applicability

The lubricating oil composition of the present invention has excellent oxidation stability despite low ash, exhibits small increase in viscosity and acid number, and can prolong the interval (distance or time) required for changing lubricating oil. Therefore, the lubricating oil composition is particularly suitable for internal combustion engines such as gasoline engines, diesel engines, engines employing dimethyl ether fuel, and gas engines.

The invention claimed is:

1. A lubricating oil composition, comprising:

a lube base oil comprising at least one of a mineral oil and a synthetic oil;

an ashless dispersant comprising at least one of a boron-containing derivative of an alkenylsuccinic acid monoimide and an alkenylsuccinic acid monoimide and at least one of a boron-containing derivative of an alkenylsuccinic acid bisimide and an alkenylsuccinic acid bisimide;

an antioxidant comprising a dialkyldiphenylamine compound and a hindered phenol compound, the dialkyldiphenylamine compound being present in an amount of 0.3 to 2.0% by mass of the composition and the hindered phenol compound being present in an amount of 0.2 to 2.5% by mass of the composition;

wherein:

the ashless dispersant is present in an amount of 0.01 to 0.14% by mass of the composition in terms of nitrogen content;

the at least one of the boron-containing derivative of the alkenylsuccinic acid monoimide and the alkenylsuccinic acid monoimide is present in an amount of 0.05% or less by mass of the composition in terms of nitrogen content; and a sulfated ash of the composition is 1.2% by mass or less.

2. The lubricating oil composition of claim 1, wherein the composition comprises at least one boron-containing derivative of succinic acid monoimide or boron-containing derivative of succinic acid bisimide having an alkenyl group or an alkyl group having a weight average molecular weight of 500 to 3000.

3. The lubricating oil composition of claim 1, further comprising a metallic detergent in an amount of 100 to 2,800 ppm by mass of the composition in terms of metal content, wherein the metallic detergent comprises an alkaline earth metal salicylate having a base number of 30 to 600 mgKOH/g.

4. A method, comprising employing the lubricating oil composition of claim 1 in a diesel engine.

5. The lubricating oil composition of claim 1, wherein a mass ratio of boron-containing derivatives of succinic acid monoimides to succinic acid bisimides in the composition in terms of nitrogen content is 1 or less.

* * * * *